US006467558B2

(12) United States Patent
Miyamoto et al.

(10) Patent No.: US 6,467,558 B2
(45) Date of Patent: Oct. 22, 2002

(54) MULTIPLE AIR HAMMER APPARATUS AND EXCAVATING DIRECTION CORRECTING METHOD THEREFOR

(75) Inventors: Osamu Miyamoto, Kashiwa (JP); Yoshio Akiyama, Yamato (JP); Taro Watanabe, Tokyo (JP)

(73) Assignee: Tone Corporation, Tokyo (JP)

( * ) Notice: Subject to any disclaimer, the term of this patent is extended or adjusted under 35 U.S.C. 154(b) by 8 days.

(21) Appl. No.: 09/725,947

(22) Filed: Nov. 30, 2000

(65) Prior Publication Data

US 2001/0006120 A1 Jul. 5, 2001

(30) Foreign Application Priority Data

Dec. 3, 1999 (JP) ..... 11-344798
Oct. 27, 2000 (JP) ..... 2000-328861

(51) Int. Cl.[7] ..... E21B 4/14

(52) U.S. Cl. ..... 175/71; 175/96; 175/107; 175/173; 175/296; 175/418

(58) Field of Search ..... 175/62, 53, 96, 175/71, 107, 173, 266, 267, 296, 417, 418; 405/138, 139

(56) References Cited

U.S. PATENT DOCUMENTS 3,682,258 A * 8/1972 Kelly, Jr. et al. ..... 175/96
4,878,547 A * 11/1989 Lennon ..... 175/53
5,386,878 A * 2/1995 Rowekamp ..... 175/62
5,735,358 A * 4/1998 Lyon ..... 175/96

FOREIGN PATENT DOCUMENTS

CH 613491 A * 9/1979
JP 3-45195 11/1984
JP 03151492 A * 6/1991

* cited by examiner

*Primary Examiner*—David Bagnell
*Assistant Examiner*—Zakiya Walker
(74) *Attorney, Agent, or Firm*—Nixon Peabody LLP; David S. Safran

(57) ABSTRACT

Three air hammers are housed and arranged in a hammer case, and have bits at their respective ends. Each of the air hammers can be activated independently. In a normal excavation, the earth is excavated by activating all the air hammers. When correcting an excavating direction, only an air hammer positioned in the correct direction is activated first so that the earth in the correct direction is excavated in a predetermined amount. Next, all the air hammers are activated to excavate the earth. Thereby, a leading hammer can direct the excavation toward the correct direction, and thus the excavating direction is corrected.

11 Claims, 15 Drawing Sheets

STATE OF BIT STATE OF AIR SWIVEL

MULTIPLE AIR HAMMER APPARATUS AND EXCAVATING DIRECTION CORRECTING METHOD THEREFOR

BACKGROUND OF THE INVENTION

1. Field of the Invention

The present invention relates to a multiple air hammer apparatus including a plurality of air hammers and its excavating direction correcting method.

2. Description of Related Art

A conventional multiple air hammer apparatus including a plurality of air hammers distributes the air supplied from one air supply line to each of the air hammers to activate it. Because of that, in the conventional air hammer apparatus, all the air hammers are simultaneously activated as the air is supplied from the air supply line, and are simultaneously stopped as the air supply is stopped.

The multiple air hammer apparatus with such construction has a problem in that: when one of the air hammers becomes a leaking state, the other air hammers cannot be sufficiently supplied with the air, so that the striking power becomes weakened, which leads to decreased excavation. To prevent this malfunction, very large amounts of air must be supplied to the multiple air hammer apparatus.

Japanese Patent Publication No. 3-45195 discloses a multiple air hammer apparatus that is provided with a function to correct an excavating direction. However, if the air hammer apparatus has such an excavating direction correcting function, the device is large and complex. Moreover, its correction operation takes considerable time.

SUMMARY OF THE INVENTION

The present invention has been developed in view of the above-described circumstances, and has as its object the provision of a multiple air hammer apparatus and its excavating direction correcting method which has a simple construction, which is energy efficient, and which can easily correct the excavating direction.

In order to achieve the above-described objects, the present invention is directed to a multiple air hammer apparatus in which a plurality of air hammers for striking bits mounted at a front end are disposed in a case and are activated by air supply, wherein: each of the plurality of air hammers is independently operatable.

According to the present invention, in a straight excavation, the earth is excavated by activating all the air hammers. In contrast, when correcting the excavating direction, only an air hammer which is positioned in the correct direction is activated first, and only the earth in the correct direction is excavated by striking and vibrating in a predetermined amount. Next, the earth is excavated by striking by rotating all the air hammers. Thereby, the air hammer apparatus progresses excavation toward the direction that the excavation is advanced, that is, the correct direction, and thus the excavating direction is corrected.

In order to achieve the above-described objects, the multiple air hammer apparatus is preferably characterized in that the bits are provided with an extending/contracting mechanism.

According to the present invention, in a case where the excavation progresses by building-in a casing at the same time as the excavation, the air hammer can be pulled out and be collected to the starting side by contracting a bit after the excavation has been carried out. Thereby, the excavation can be carried out regardless of existence and a size of the reached vertical shaft.

Moreover, in order to achieve the above-described object, the present invention is directed to an excavation direction correcting method of a multiple air hammer apparatus in which a plurality of air hammers for striking bits mounted at a front end are disposed in a case and are activated by air supply, wherein: a striking power of each of the bits is adjusted by separately controlling operation of one of the plurality of air hammers so as to correct an excavating direction.

According to the present invention, the excavating direction is corrected by, for example, activating only the air hammer that is positioned in a direction corresponding with the correct excavating direction and stopping the operations of all the other air hammers. Alternatively, the excavating direction is corrected by taking advantage of a difference in excavating speeds caused by differentiating the striking power of the air hammer that is positioned in the direction corresponding with the correct excavating direction.

In order to achieve the above-described objects, the present invention is directed to a swivel device which supplies fluid into each of a plurality of rotating supply pipes, the swivel device comprising: a case; a rotation body which is rotatably provided to the case, an end of the rotation body being connected with the plurality of supply pipes; a plurality of recesses which are formed at the rotation body with predetermined intervals and define supply chambers between the rotation body and the case; a plurality of supply passages which are formed at the rotation body and respectively connect the supply chambers and the supply pipes to each other; and a plurality of supply channels which are formed at the case with predetermined intervals and communicate with the case.

According to the present invention, the positions of the supply chambers are changed with the rotation of the rotation body, so that the supply channels connecting to each supply chamber are successively changed. Hence, if the fluid is supplied to only a particular supply channel, the fluid is supplied to only the supply chamber being connected to the particular supply channel, so that the fluid can be selectively supplied to the supply pipe that is being positioned to a particular direction. Thus, in an excavation apparatus provided with a plurality of excavation tools for example, the excavation direction can be corrected easily and efficiently.

In order to achieve the above-described objects, the present invention is directed to a multiple air hammer apparatus, comprising: a case; a rotation body which is rotatably provided to the case, an end of the rotation body being connected with a plurality of supply pipes; a plurality of recesses which are formed at the rotation body with predetermined intervals and define supply chambers between the rotation body and the case; a plurality of supply passages which are formed at the rotation body and respectively connect the supply chambers and the supply pipes to each other; and a plurality of supply channels which are formed at the case with predetermined intervals and communicate with the case, wherein activation air is supplied from an air supply device to each of the plurality of supply channels selectively so as to control activation of air hammers and correct an excavating direction.

According to the present invention, the activation air is supplied through all the supply channels in the straight excavation. The supplied activation air is supplied to the supply chambers that rotate and communicate with the supply channels, and is further supplied from the supply chamber to the air hammers via the supply passages and the supply pipes. Thereby, all the air hammers are activated and the earth is uniformly excavated to thus be excavated straight. In contrast, when correcting the excavating direction, for example, an air pressure of the activation air that is supplied to the supply channel positioned in the correct direction is set higher than an air pressure of the activation air that is supplied to the other supply channels, and the activation air is supplied. By this method, only the air hammer communicating with the supply channel at the correct direction can excavate the earth with a stronger striking power than the others; in consequence the entire air hammers gradually progress in the correct direction and thus the excavating direction is corrected. As described above, the excavating direction can be easily corrected by only controlling the supply operation of the activation air that is supplied to the air hammers.

In order to achieve the above-described objects, the present invention is directed to a multiple air hammer apparatus, comprising: a hammer case; a target provided on a central axis of the hammer case, the target being provided with a plurality of measurement points on a line from the center to a radial direction with predetermined intervals, wherein a deviation of the hammer case with respect to a planned design line is determined by determining positions of the plurality of measurement points with respect to the planned design line.

In order to achieve the above-described objects, the present invention is directed to a multiple air hammer apparatus, comprising: a hammer case; a plurality of air hammers which are housed and arranged in the hammer case and are activated by air supply so as to strike bits mounted at a front end; a rod which is coaxially connected with a back end of the hammer case; a plurality of supply pipes which are connected with the hammer case and supply activation air to the air hammers, respectively; and a swivel device which supplies the activation air from an air supply device to the plurality of supply pipes, wherein the multiple air hammer apparatus is arranged so as to be insertable into a casing.

In order to achieve the above-described objects, the present invention is directed to a rod which is connected with a multiple air hammer apparatus provided with a plurality of air hammers, supplies air to the multiple air hammer apparatus, and transmits rotation force and propulsive power to the multiple air hammer apparatus, the rod comprising: a main pipe which is hollow; a plurality of air supply pipes disposed around the main pipe, the plurality of air supply pipes respectively supplying the air to the air hammers; and connections which are formed at both ends of the main pipe and the plurality of air supply pipes.

According to the present invention, the air can be separately supplied to each of the air hammers from the plurality of air supply passages, which are disposed around the main pipe; thereby, each of the air hammers can be separately activated.

Preferably, the rod further comprises a water supply pipe arranged around the rod.

According to the present invention, water can be delivered because of the water supply pipe provided around the main pipe.

Preferably, the rod further comprises an auger wing arranged around the main pipe.

According to the present invention, the excavated soil can be efficiently discharged because of the auger wing around the main pipe.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Hereunder preferred embodiments of the multiple air hammer apparatus and excavating direction correction method therefor according to the present invention will be described in detail with reference to the accompanied drawings.

Figure 1:
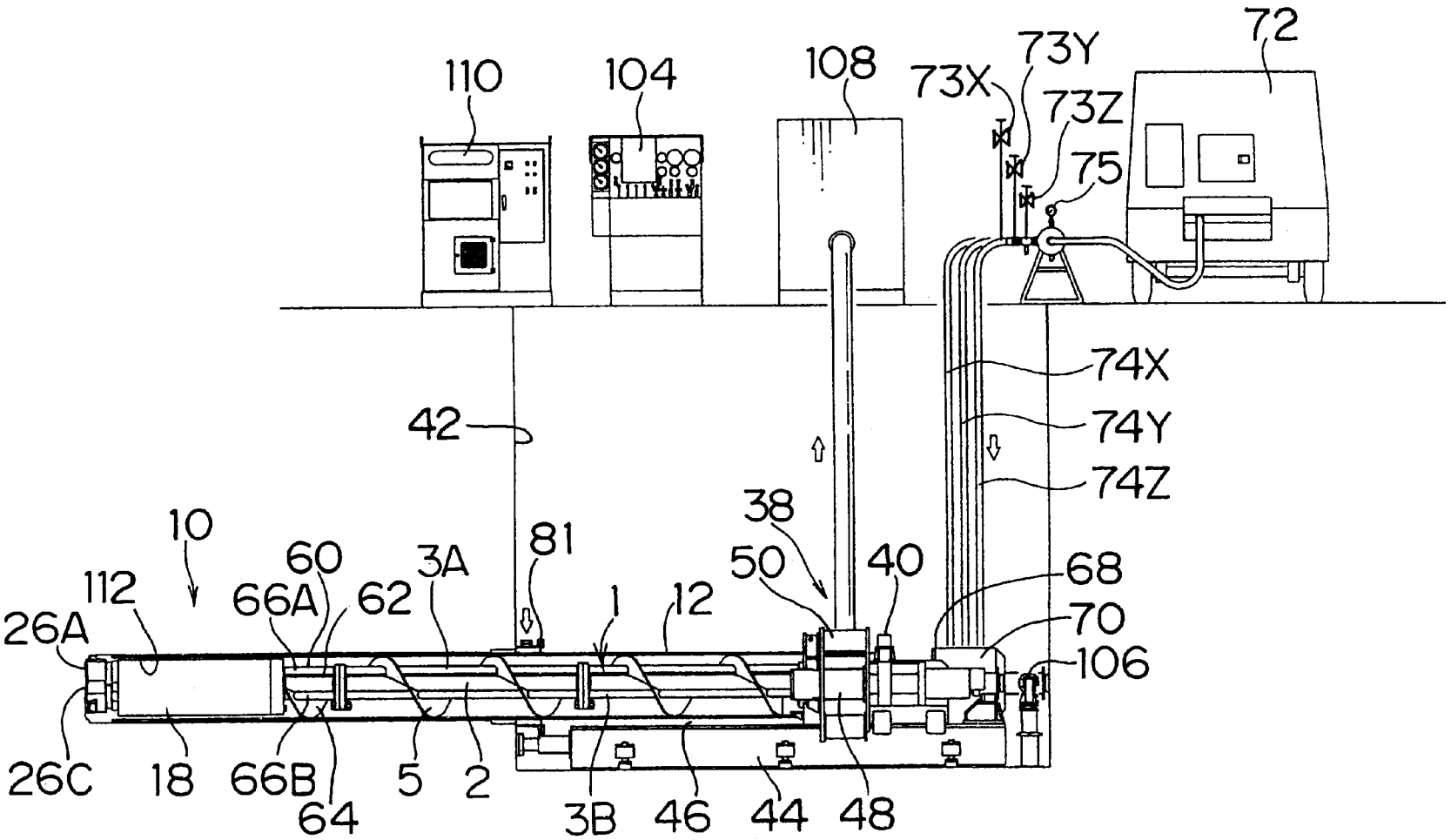
FIG. 1 is a side view of a multiple air hammer apparatus.

FIG. 1 is a side view of a multiple air hammer apparatus, which comprises a leading hammer 10 and a propulsive device 40. The leading hammer 10 excavates the earth and leads a casing 12, and the propulsive device 40 provides rotation and propulsive power to the leading hammer 10.

Figure 2:
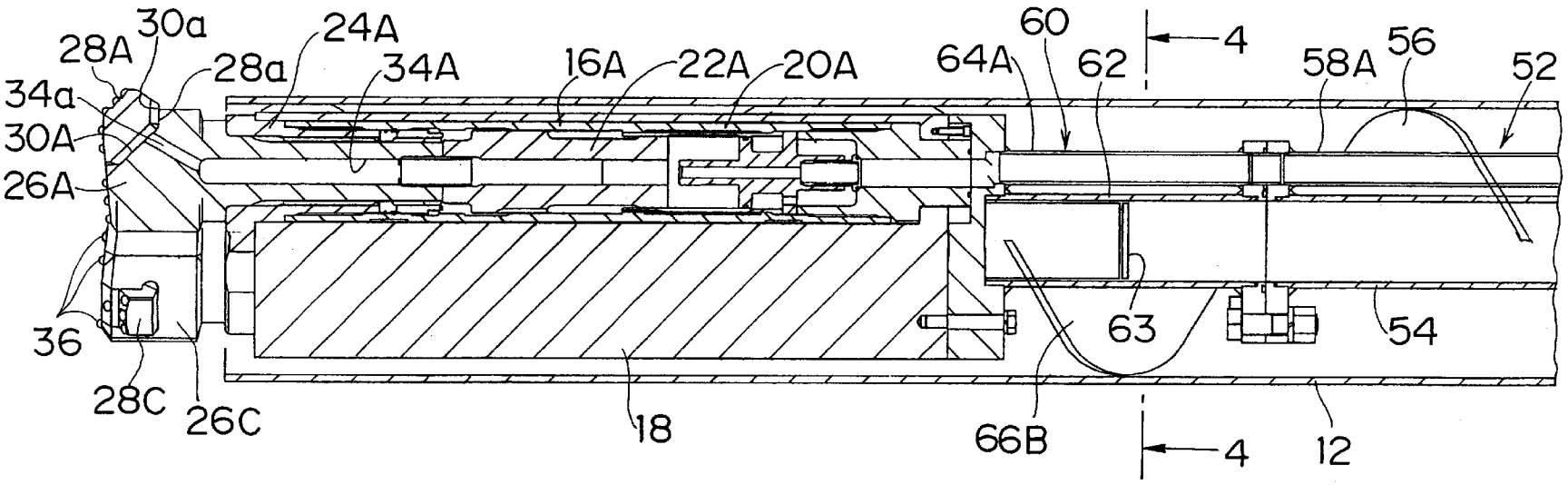
FIG. 2 is a side section view of a leading hammer.
Figure 3:
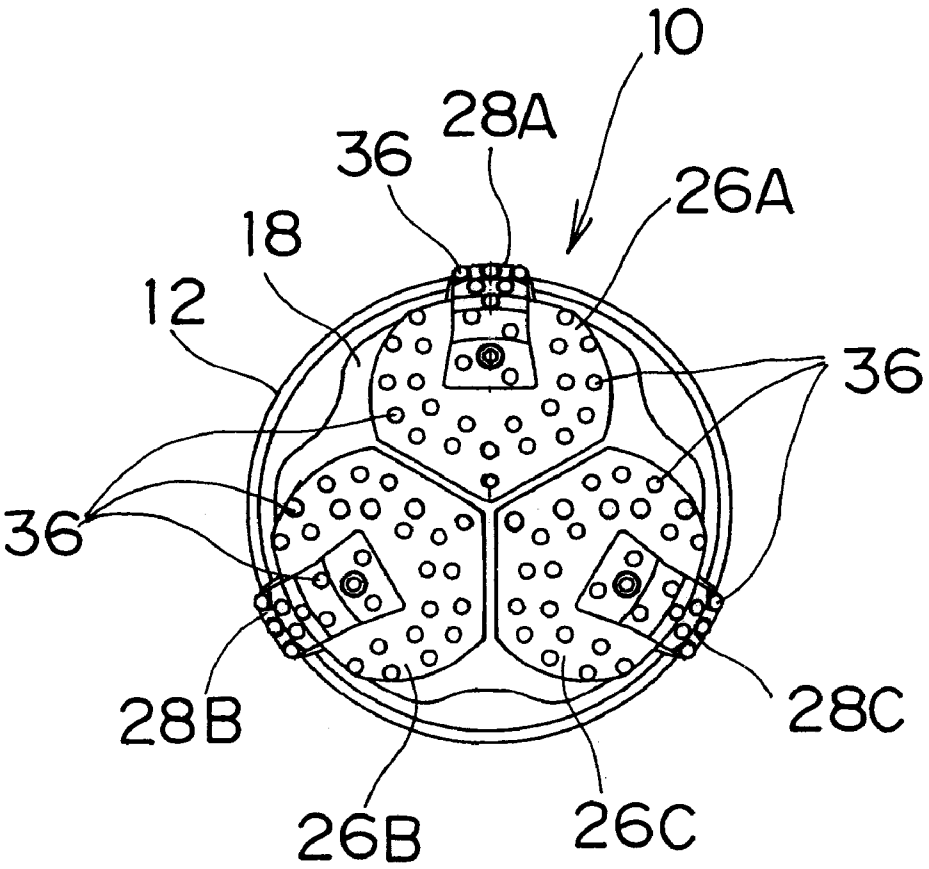
FIG. 3 is a front view of the leading hammer.
Figure 4:
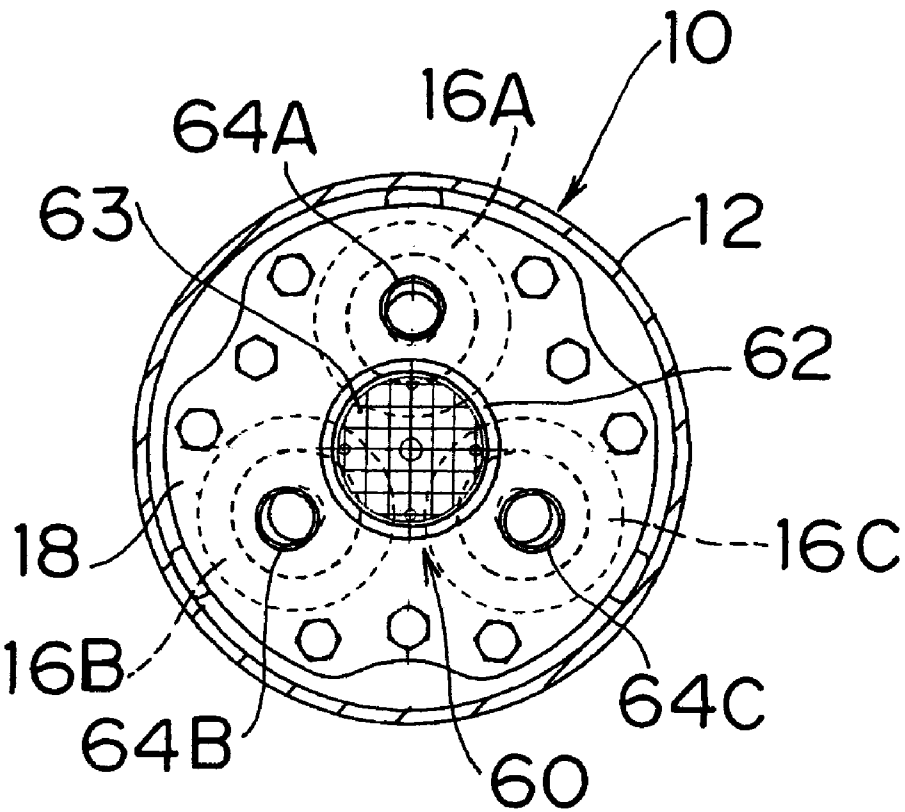
FIG. 4 is a section view of the leading hammer along line 4—4 in FIG. 2.

Initially, the construction of the leading hammer 10 is described. As shown in FIGS. 2–4, the leading hammer 10 is provided with a hammer case 18, in which three air hammers 16A, 16B and 16C are housed. The air hammers 16A–16C comprise hammer cylinders 20A–20C and hammer pistons 22A–22C. The hammer cylinders 20A–20C are cylindrical, and bit chucks 24A–24C are mounted at the front ends of the hammer cylinders 20A–20C. Bits 26A–26C are slidably supported at the bit chucks 24A–24C. The hammer pistons 22A–22C are slidably provided in the hammer cylinders 20A–20C. The hammer pistons 22A–22C slide in the hammer cylinders 20A–20C when being driven with the air supplied from air supply pipes 3A–3C, which will be described later. The hammer pistons 22A–22C slide in the hammer cylinders 20A–20C, and the back end faces of the bits 26A–26C are thereby struck by the hammer pistons 22A–22C.

As shown in FIG. 3, the bits 26A–26C are in the same form, and they are connected to substantially form a circle as a whole. Bit teeth 28A–28C are provided to the bits 26A–26C for extending the outer diameters of the bits 26A–26C by projecting from the outer peripheries of the bits 26A–26C.

As shown in FIG. 2, the bit teeth 28A–28C are slidably provided to guide grooves 30A–30C, which are respectively formed at the front ends of the bits 26A–26C. The guide grooves 30A–30C are formed radially from the center of the hammer case 18, and they are respectively formed by inclining at a predetermined angle with respect to the axis of the hammer case 18. Each of the guide grooves 30A–30C and the bit teeth 28A–28C is formed like a trapezoid in its section, whereby the bit teeth 28A–28C are prevented from falling off the guide grooves 30A–30C.

Stopper pins (not shown) for regulating the moving range of the bit teeth 28A–28C are fixed at the bit teeth 28A–28C. The stopper pins are fitted with stopper grooves (not shown), which are formed at the guide grooves 30A–30C. The stopper grooves are formed in a predetermined length along the guide grooves 30A–30C, so that moving of the bit teeth 28A–28C in the front end direction is regulated by contacting the stopper pins with the front ends of the stopper grooves. Moving of the bit teeth 28A–28C in the back end direction is regulated by contacting back ends 28*a*–28*c* of the bit teeth 28A–28C with back end faces 30*a*–30*c* of the guide grooves 30A–30C.

The bit teeth 28A–28C constructed as described above project from the outer peripheries of the bits 26A–26C by moving in the back end direction (direction to the right-hand side in FIG. 2) of the leading hammer 10, whereby the outer diameters of the bits 26A–26C extend. At this moment, the front end faces of the bit teeth 28A–28C are on the same plane as the front end faces of the bits 26A–26C.

On the other hand, the bit teeth 28A–28C retract from the outer peripheries of the bits 26A–26C by moving in the front end direction (direction to the left-hand side in FIG. 2) of the leading hammer 10, whereby the outer diameters of the bits 26A–26C are contracted. At this moment, the outer peripheral faces of the bit teeth 28A–28C are flush with the outer peripheral faces of the bits 26A–26C.

Exhaust channels 34*a*–34*c* are formed at the guide grooves 30A–30C of the bits 26A–26C, respectively, and the air that is used for activation of the air hammers 16A–16C is discharged through the exhaust channels 34*a*–34*c* into an excavation hole 112. Since the air is discharged through the exhaust channels 34*a*–34*c*, the guide grooves 30A–30C are prevented from being clogged by the excavated soil.

Sufficient number of metal chips (e.g., made of cemented carbide) 36, 36, . . . are fixed at the front end faces of the bits 26A–26C and the bit teeth 28A–28C, and the earth is struck by the metal chips 36, 36, . . . and excavated.

The front end face (striking face) of each of the bits 26A–26C inclines toward the center of the leading hammer 10, so that the front faces of the bits 26A–26C define a concave face as a whole. Because of that, when only one of the air hammers is operated or only one of the air hammers is operated harder than the others, a correction effect improves by the strike reaction force generated from the concave inclined face toward the outer periphery.

Next, the construction of the propulsive device 40 is described. As shown in FIG. 1, a propulsive base 44 is horizontally provided in a starting vertical shaft 42. A guide rail 46 is laid on the propulsive base 44, and the propulsive device 40 is slidably supported on the guide rail 46. The propulsive device 40 is connected with a propulsive cylinder 48. The propulsive device 40 is driven by the propulsive cylinder 48 so as to slide on the guide rail 46. The propulsive device 40 is connected also with a soil discharge case 50. The casing 12 is supported on the front face of the soil discharge case 50, and a rod 1 is inserted through the casing 12.

Figure 5:
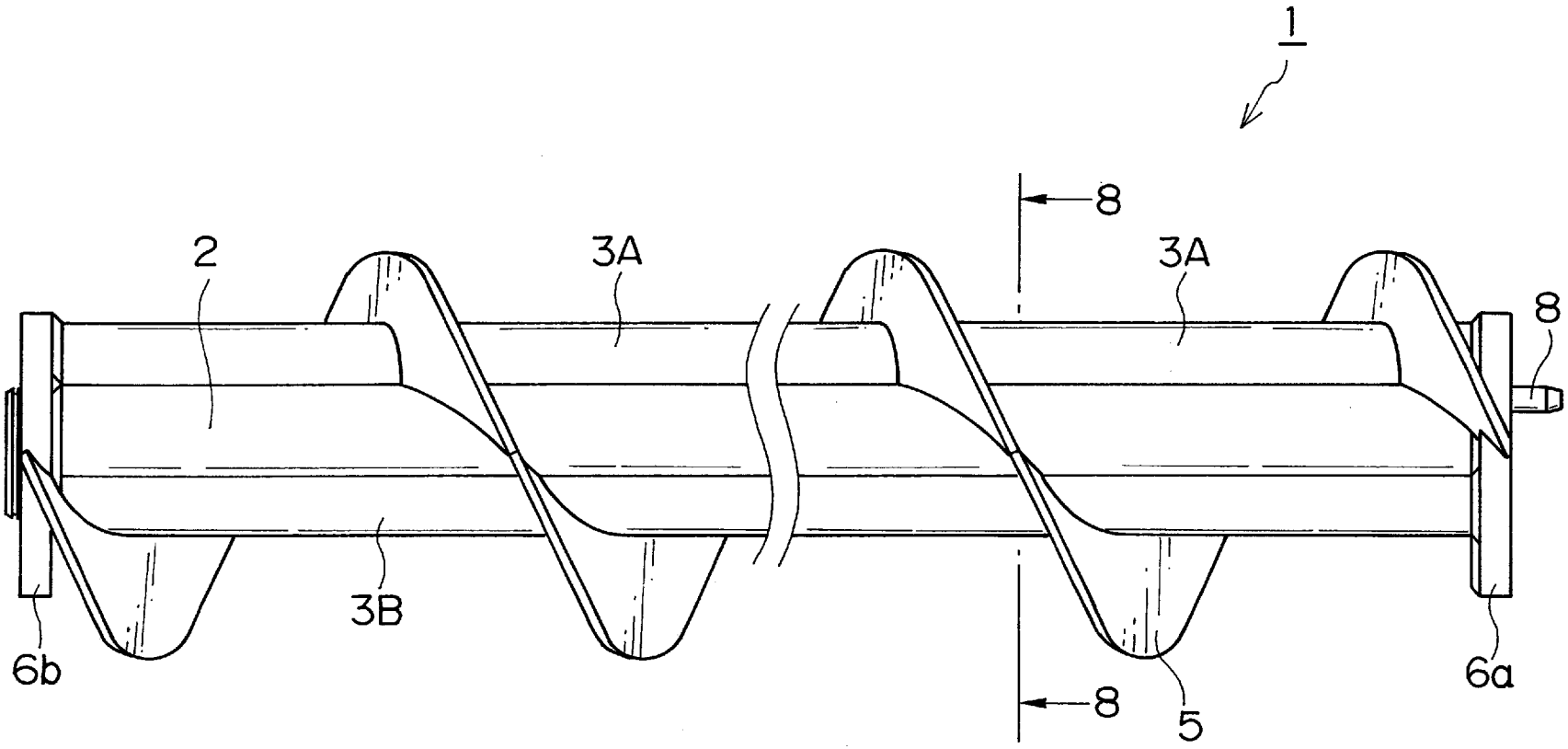
FIG. 5 is a side view of a rod.
Figure 6:
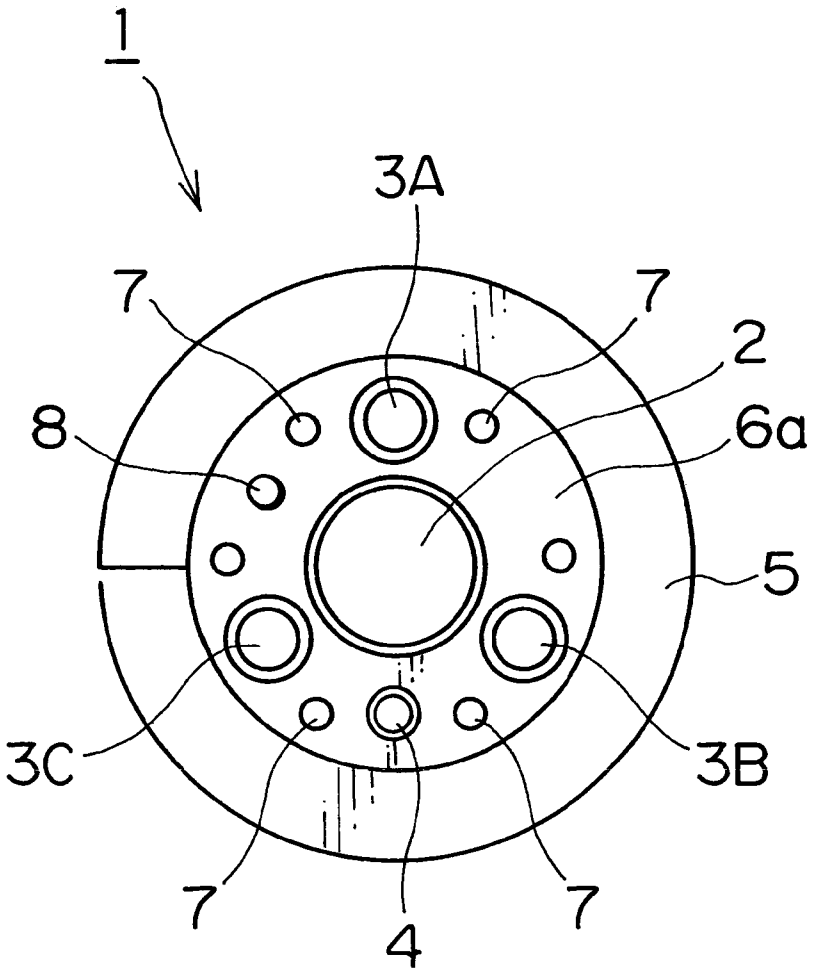
FIG. 6 is a front view of the rod.
Figure 7:
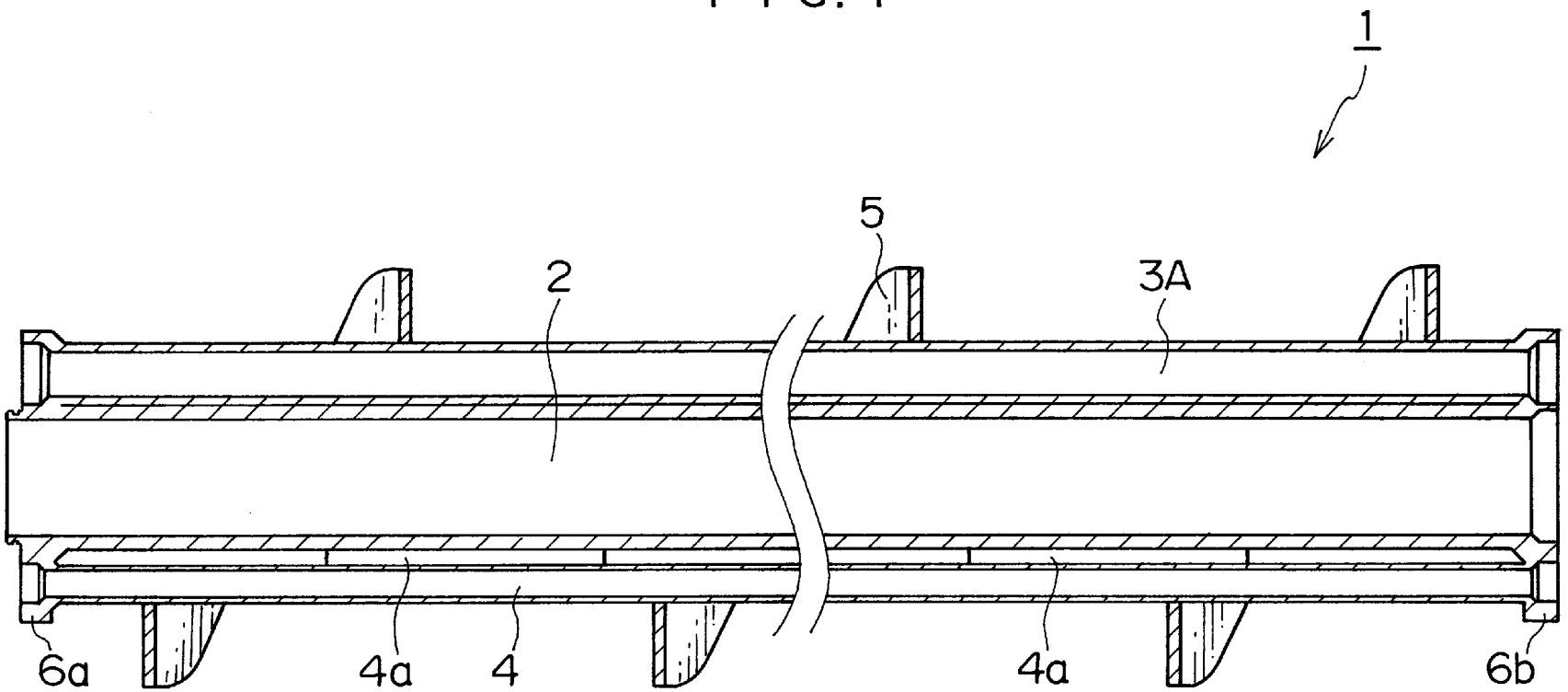
FIG. 7 is a side section view of the rod.
Figure 8:
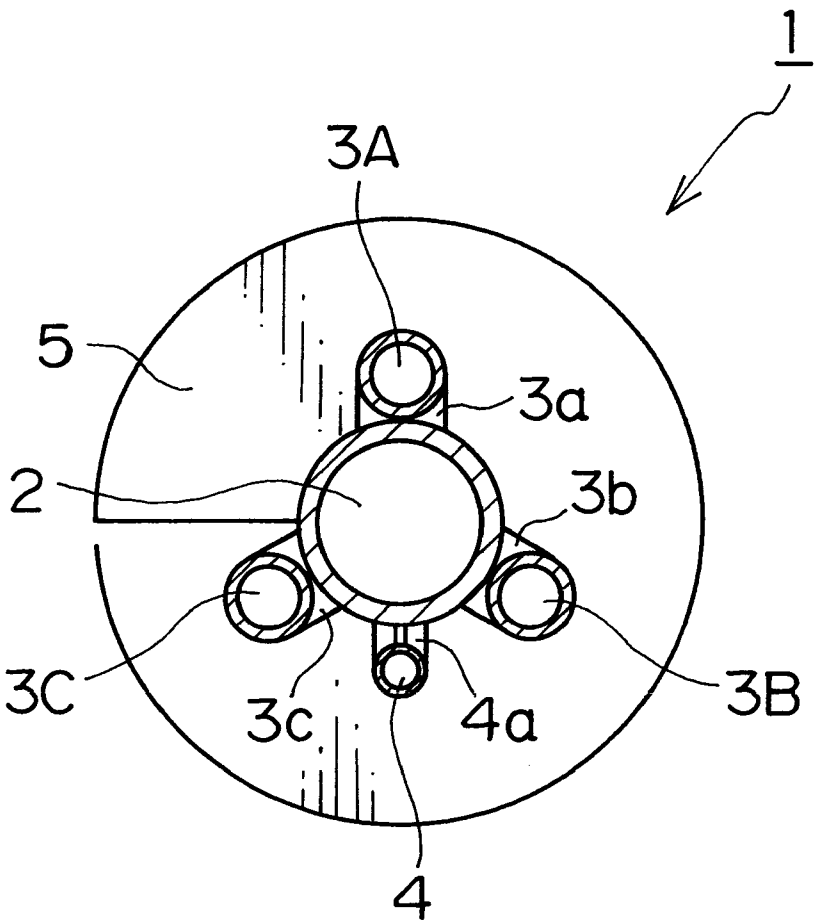
FIG. 8 is a section view of the rod along line 8—8 in FIG. 5.

FIGS. 5, 6 and 7 are a side view, a front view and a side section view, respectively, of the rod 1, and FIG. 8 is a section view of the rod 1 along line 8—8 in FIG. 5. The rod 1 is constructed in which the three air supply pipes 3A, 3B and 3C and a water supply pipe 4 are integrally fixed around the main pipe 2.

The main pipe 2 is hollow, and on its peripheral face, a spiral-shaped auger wing 5 is integrally fixed. Flanges 6*a* and 6*b* for connecting the rods 1 with each other are also integrally fixed at both ends of the main pipe 2. The flanges 6*a* and 6*b* have a plurality of bolt holes 7, 7, . . . for fastening the flanges with each other with bolts. A positioning pin 8 is projected at the flange 6*a* while a pin hole (not shown) is formed at the other flange 6*b*. In order to connect the rods 1, the positioning pin 8 that is formed at the flange 6*a* of the rod 1 is fitted with the pin hole that is formed at the flange 6*b* of the other rod 1; thereby, the main pipes 2, the air supply pipes 3A, 3B and 3C, and the water supply pipes 4 of the rods 1 to be connected with each other are respectively positioned so as to communicate with each other.

The three air supply pipes 3A, 3B and 3C are hollow, and have the same length as the main pipe 2. The three air supply pipes 3A, 3B and 3C are disposed to be parallel with the main pipe 2, and are disposed with a predetermined space to define a circle concentric with the main pipe 2. The three air supply pipes 3A, 3B and 3C are integrally fixed on the peripheral face of the main pipe 2 through fixing portions 3*a*, 3*b* and 3*c*.

The water supply pipe 4 is hollow, and has the same length as the main pipe 2. The water supply pipe 4 is disposed to be parallel with the main pipe 2, and is integrally fixed on the peripheral face of the main pipe 2 through a fixing portion 4*a*.

The rod 1, which is constructed as described above, is connected with a case rod 60, which is formed at the back end of the hammer case 18. The case rod 60 is provided at the center of the hammer case 18, and has the same construction as the rod 1. More specifically, an auger wing 64 is integrally fixed on the outer periphery of a hollow shaft 62, while air supply pipes 66A, 66B and 66C, which are independent from each other, and a water supply pipe are disposed around the hollow shaft 62. The case rod 60 and the rod 1 are connected with each other so that their hollow shafts, the air supply pipes, and the water supply pipes are respectively connected with each other.

As shown in FIG. 4, in the hollow shaft 62 of the case rod 60, a target 63 for position determination is provided which has a scale in a pattern of a grid. The target 63 is arranged at the center of the hammer case 18. The target 63 may be provided in the hammer case 18.

As shown in FIG. 1, a rod rotating device 68 is provided to the propulsive device 40. The rod 1 is driven by the rod rotating device 68 so as to rotate, or to turn to and fro, successively or intermittently. The leading hammer 10 rotates, or turns to and fro, by the rotation or turn of the rod 1. The rod rotating device 68 is provided with a rotation angle determination device by which the rotation angle of the leading hammer 10 can be determined.

As seen again from FIG. 1, the propulsive device 40 has a swivel device 70, which is provided with three independent passages. The air is supplied from a compressor 72, which is arranged on the ground, through the swivel device 70 to the three air supply pipes 3A, 3B and 3C, which are disposed at the rod 1. The air that is supplied to the air supply pipes 3A, 3B and 3C is further supplied to the air hammers 16A–16C of the leading hammer 10, whereby the air hammers 16A–16C are activated.

The air supply amount for each of the air hammers 16A–16C is adjusted by separately controlling the opening and closing amount of each of the valves 73X–73Z, which are correspondingly provided with the air hammers 16A–16C. By such individual control of the air supply amount for each of the air hammers 16A–16C, the striking power of each of the air hammers 16A–16C can be separately adjusted or stopped operation. The opening and closing operation of each the valves 73X–73Z is separately controlled by a remote-controlled operation from an operation board 104 or manual operation.

A reference numeral 106 in FIG. 1 is assigned to a laser theodolite, which is used for measuring an inclining amount of the leading hammer 10. A detailed measurement method is as presented below.

The laser theodolite 106 emits a laser beam toward the target 63 provided to the case rod 60. The laser beam is emitted from the laser theodolite 106 to be in parallel with a planned design line. If the leading hammer 10 is performing the excavation as planned, the laser beam hits the center of the target 63. Thus, a deviation amount of the leading hammer 10 with respect to the planned design line can be determined by measuring a deviation amount of the hitting point of the laser beam on the target 63 with respect to the center of the target 63. If the laser beam is off upward from the center of the target 63, it is indicated that the leading hammer 10 deviates downward from the planned line. The display on the target 63 is transmitted via a cable communication or a radio communication by a position sensor (not shown) provided in the hollow shaft 62, and the image is displayed on a monitor (not shown) on the operation board 104, which is arranged on the ground. The operator operates the operation board 104 while looking at the image on the monitor and performs correction as required.

A reference numeral 108 in FIG. 1 is assigned to a soil discharging device, which discharges excavated soil that is collected in the soil discharging case 50 to the ground. The soil that is excavated by the bits 26A–26C of the leading hammer 10 is carried by the exhaust air to the casing 12 through a space between the hammer case 18 and the casing 12. The excavated soil is then transported with the exhaust air to the soil discharging case 50 by the rotating rod 1, and is discharged to the ground by the soil discharging device 108. Since the rod 1 is provided with the auger wing 5, the excavated soil can be efficiently discharged to the ground regardless of excavated distance.

A reference numeral 110 in FIG. 1 is assigned to a hydraulic unit for driving the propulsive cylinder 48 and so forth, and a reference numeral 81 in FIG. 1 is an entrance packer for injecting slip additive and preventing the air leakage.

The operation of the multiple air hammer apparatus which is constructed as described above is as presented below.

First, the bits 26A–26C provided at the front end of the leading hammer 10 are contacted with a working face, and the propulsive cylinder 48 of the propulsive device 40 is driven, whereby the leading hammer 10 and the casing 12 are propelled.

At the same time as the driving of the propulsive cylinder 48, the rod rotating device 68 is driven so as to rotate the rod 1. Thereby, the rotation of the rod 1 is transmitted to the leading hammer 10, and the leading hammer 10 rotates.

Moreover, the compressor 72 is driven at the same time as the driving of the rod rotating device 68, and the valves 73X–73Z are opened. Thus, the air is supplied to the air supply pipes 3A–3C of the rod 1 from the compressor 72 through a line oiler 75, the valves 73X–73Z, air pipes 74X, 74Y and 74Z, and the swivel device 70. The air is then supplied to the air hammers 16A–16C of the leading hammer 10, so that the air hammers 16A–16C are activated. More specifically, the hammer pistons 22A–22C of the air hammers 16A–16C are activated and strike the bits 26A–26C; thereby, the working face is repeatedly struck by the bits 26A–26C and is crushed.

At this point, the bit teeth 28A–28C provided to the bits 26A–26C move in the direction to retreat from the front end face by contacting the working face so as to extend. By this extending of the bit teeth 28A–28C, an excavation hole 112 with a larger diameter than that of the casing 12 is excavated.

The excavated soil that is excavated by the bits 26A–26C is discharged into the casing 12 through the space between the casing 12 and the hammer case 18 by the effect of the exhaust air. The excavated soil that is discharged to the casing 12 is transported with the exhaust air to the soil discharging case 50 by the effect of the rotating rod 1, and is collected from the soil discharging case 50 by the soil discharging device 108.

Figure 9:
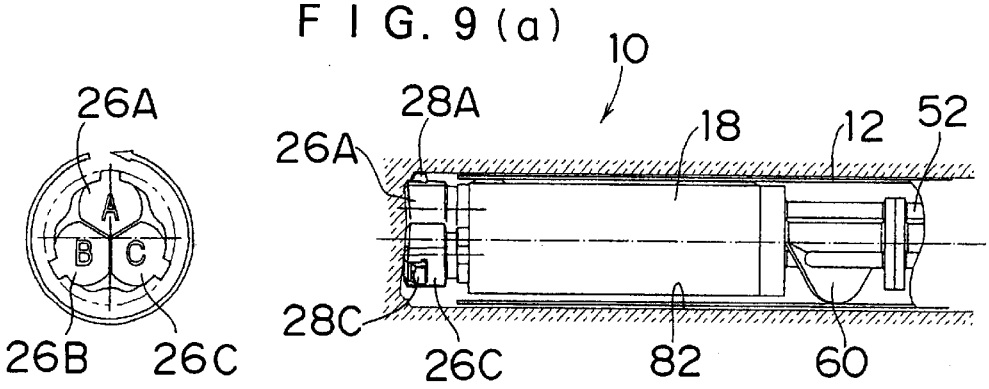
FIGS. 9(*a*)–9(*c*) are explanatory views for the operation of the multiple air hammer apparatus.
Figure 9:
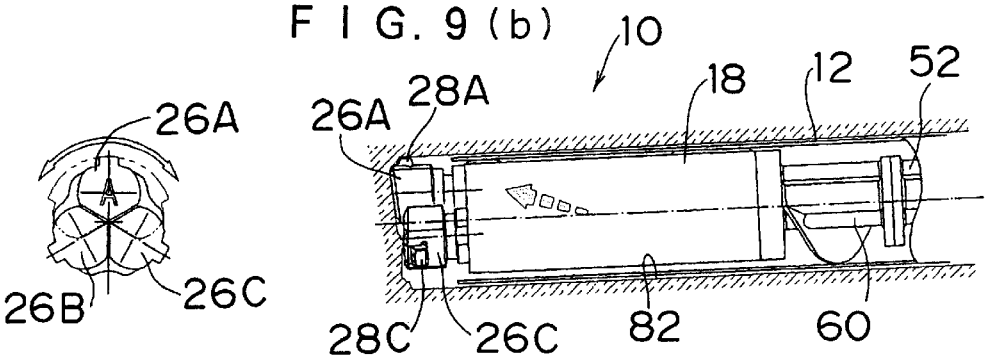
Figure 9:
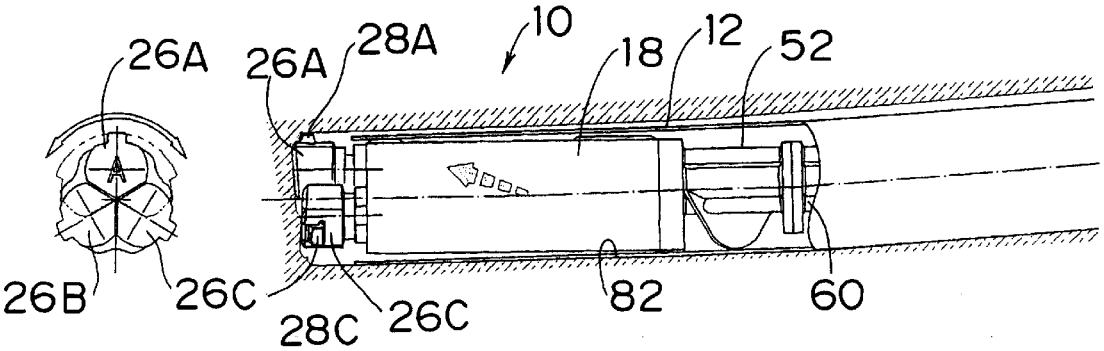

As presented above, in the normal excavation, the leading hammer 10 is rotated in one direction and the respective air hammers 16A–16C are uniformly activated so as to excavate the ground (see FIG. 9(*a*)).

Now, a method is described for correcting the excavating direction when the leading hammer 10 deviates from the planned design line.

The fact that the leading hammer 10 deviates from the planned line is confirmed with the monitor on the operation board 104. It is assumed now that the leading hammer 10 has deviated downward from the planned line.

First, the excavation operation is temporally stopped, and the correct direction is confirmed from the display of the monitor.

Second, only the air hammer for the bit that is at a position corresponding with the correct direction is activated so as to strike only this particular bit. An example in FIG. 9(*b*), only the air hammer 16A is activated to strike only the bit 26A. At the same time, the rod rotating device 68 is driven so that the leading hammer 10 is turned to and fro in the range of the predetermined angle. As a result, in FIG. 9(*b*), only the earth in the correct direction, that is, the earth of the upper portion of the working face, is struck by the bit 26A and excavated.

Upon the earth in the correct direction is excavated in the predetermined amount by the above-described method, all the air hammers 16A–16C are now activated so as to strike all the bits 26A–26C. At the same time, the leading hammer 10 is rotated in one direction by the rod rotating device 68, whereby the entire working face is excavated with the bits 26A–26C. After the earth is excavated in the predetermined amount by activating all the bits 26A–26C, only the bit that is at the position corresponding with the correct direction is activated again and only the earth in the correct direction is excavated. Only the air hammer for the bit that is at the position corresponding with the correct direction is activated and the leading hammer 10 is turned to and fro in the range of the predetermined angle. By repeatedly performing both the partial excavation in only the correct direction and the entire excavation through the method described above, the excavating direction of the leading hammer 10 is gradually corrected as shown in FIG. 9(*c*) so that the excavating direction is corrected.

At this point, because the striking faces of the bits are inclined, a force component toward the correct direction is generated when the bit at the position corresponding with the correct direction is activated to strike the earth; thus, the correcting effect improves.

The above-described excavation for correction is performed by confirming the correction amount with the monitor on the operation board 104, and the excavation is completed as the desired correction is achieved. After that, the normal excavation is resumed.

As presented above, the multiple air hammer apparatus in the present embodiment has a high energy efficiency and can easily correct the excavating direction by using the air hammers 16A–16C that are separately driven and controlled. The correction of the excavating direction is possible for the entire 360 degrees.

The multiple air hammer apparatus in the present embodiment has the extendable and contractible bit teeth 28A–28C, which are provided to the 26A–26C, respectively; thus, the leading hammer 10 can be pulled out into the vertical shaft at the starting side by contracting the bit teeth 28A–28C, resulting in that the excavation can be performed regardless of the size and existence of the reaching vertical shaft.

Moreover, since the casing 12 does not have to be turned at the time of excavation, a rotation driving device for the casing does not have to be installed into the apparatus, so that the apparatus can be compact in size. The apparatus can achieve correcting of the excavating direction even in a stable environment with bedrock for which the casing is unnecessary (refer to FIG. 14(*a*)).

In the present embodiment, when correcting the excavating direction, the bit is turned to and fro about the central axis of the hammer case 18 so as to excavate the earth in the correct direction; as required, however, the excavation may be performed without turning.

In the present embodiment, when correcting the excavating direction, only the bit that is at the position corresponding with the correct direction is activated to excavate; however, all the bits may be used for such excavation by respectively setting the striking powers of the bits different. More specifically, the striking power of the bit that is at the position corresponding with the correct direction is made stronger than the striking power of the other bits (i.e. the activation pressure of the air hammer for the bit that is at the position corresponding with the correct direction is set higher than the others), and the excavation difference resulting from the different activation pressure is used to correct the excavating direction.

Further, in the present embodiment, only one bit is activated to excavate the earth when correcting the excavating direction; as required, however, the plurality of bits may be used to excavate.

Next, a multiple air hammer apparatus according to the second embodiment of the present invention will be described.

The multiple air hammer apparatus in the second embodiment controls the air supply amount to each of the air hammers with the swivel device. The construction of the swivel device is presented below.

Figure 10:
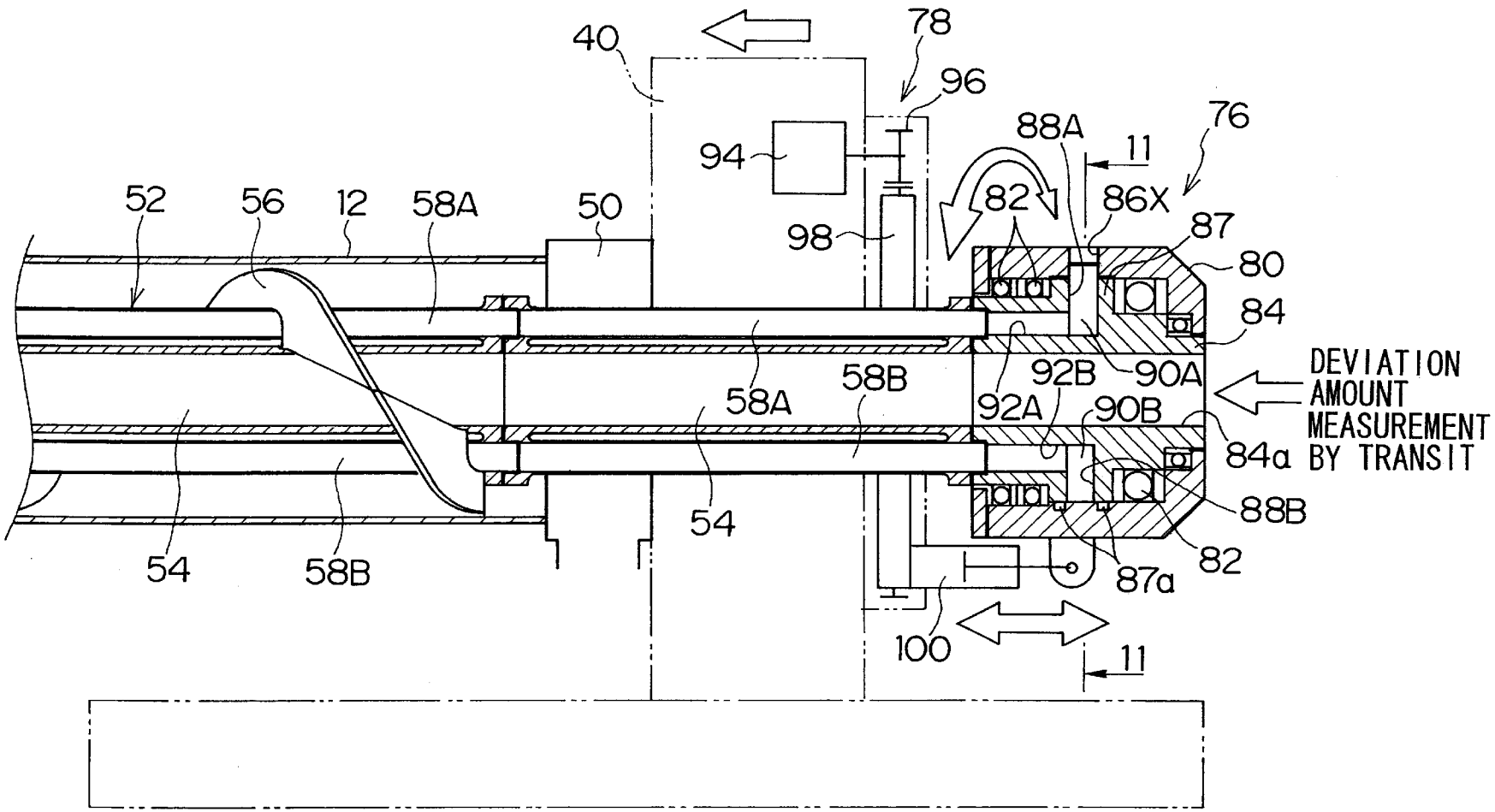
FIG. 10 is a side section view of a swivel device.

As shown in FIG. 10, the swivel device 70 comprises an swivel device body 76 and a swivel rotating device 78. The swivel device body 76 mainly comprises a case 80 and a rotating body 84.

Figure 11:
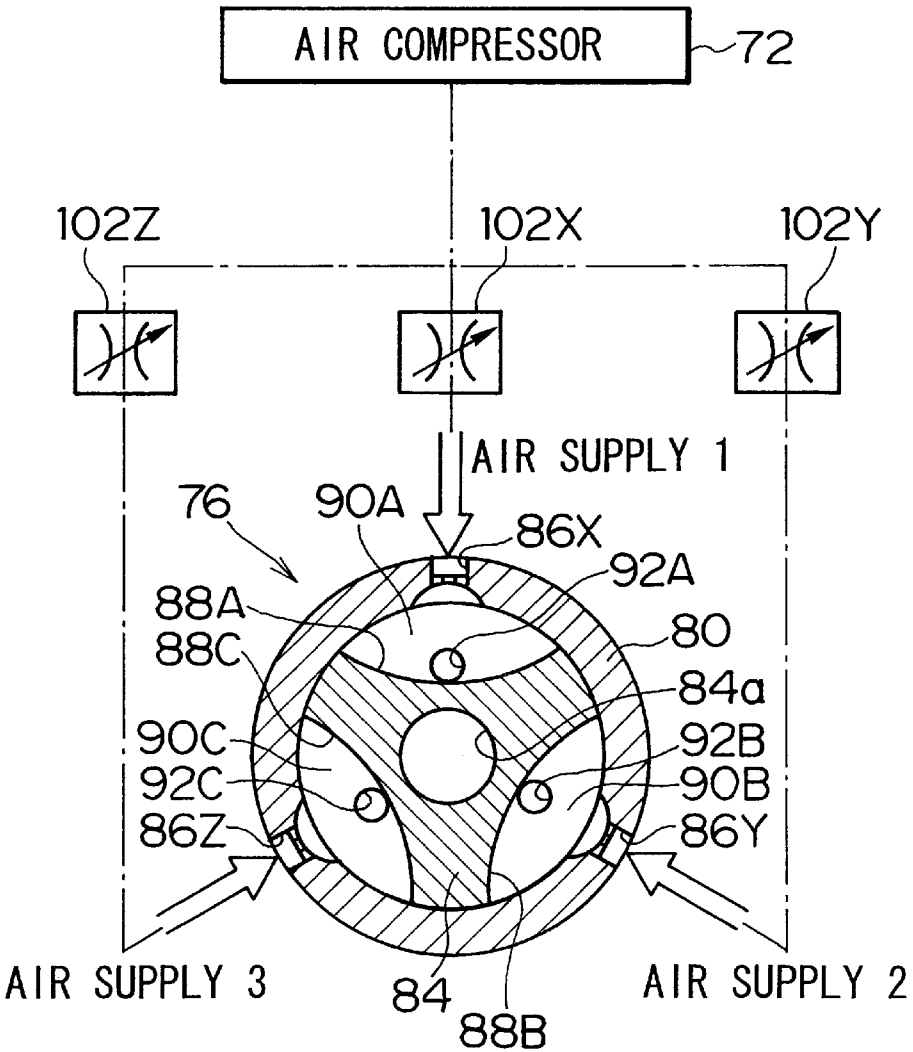
FIG. 11 is section view of the swivel device along line 11—11 in FIG. 10.

As shown in FIG. 11, the case 80 is cylindrical. Air supply channels 86X, 86Y and 86Z are formed on the outer periphery of the case 80 with predetermined intervals. The air supply pipes 74X, 74Y and 74Z, which are connected with the compressor 72, are connected with the air supply channels 86X, 86Y and 86Z.

The rotating body 84 is cylindrical and is rotatably supported at the inner periphery of the case 80 via a bearing 82. A flange 87 is formed at substantially the center of the rotation body 84, and is slidably contacted with the inner periphery of the case 80 via seals 87*a* and 87*a*. Three concave portions 88A, 88B and 88C, which are in an arched shape in section, are formed on the outer periphery of the flange 87 with predetermined intervals. The three concave portions 88A, 88B and 88C define three air supply chambers 90A, 90B and 90C between the inner periphery of the case 80 and themselves, and the activation air is supplied from the air supply channels 86X, 86Y and 86Z to the air supply chambers 90A, 90B and 90C.

The rod 1 is connected with the front end face of the rotation body 84, and the hollow shaft 54 of the rod 1 and the hollow portion of the rotation body 84 are connected with each other.

The air supply pipes 3A, 3B and 3C of the rod 1 communicate with the air supply chambers 90A, 90B and 90C through three air supply passages 92A, 92B and 92C, respectively. With this construction, when the activation air is supplied to the air supply chambers 90A–90C, the activation air goes through the air supply passages 92A–92C to the air supply pipes 3A, 3B and 3C. At this point, if the activation air is supplied to only the air supply chamber 90A, the activation air is supplied to only the air hammer 16A through the air supply passage 92A and the air supply pipe 3A, so that only the air hammer 16A is activated.

The rod 1 rotates at excavation. As the rod 1 rotates, the rotation body 84 rotates also, and thus the air supply chambers 90A–90C rotate as well. Because of that, the air is supplied to each of the air supply chambers 90A–90C only when each of the air supply chambers communicates with each of the air supply channels 86X–86Z. At this point, if the air is supplied to only the air supply channel 86X, the activation air is supplied to one of the air supply chamber 90A–90C that is communicating with the air supply channel 86X. Thereby, only one of the air hammers that is being arranged at the position corresponding with the direction of air supply channel 86X is activated, and only the earth in the direction is excavated. Thus, the earth in the selected specific direction can be excavated.

The swivel rotating device 78 rotates the case 80 of the swivel device body 76 so as to change positions of the air supply channels 86X–86Z. The swivel rotating device 78 has a motor 94, which is provided to the propulsive device 40. A driving gear 96 is fixed at the output shaft of the motor 94. The drive gear 96 is connected with a swivel rotation gear 98, which is connected with the case 80 of the swivel device body 76 via a cylinder 100. When driving the motor 94, the rotation of the motor 94 is transmitted to the swivel rotation gear 98 through the drive gear 96, and the case 80 thereby rotates. When driving the cylinder 100, the rod 1 progresses with the swivel device 70 and the leading hammer 10 progresses.

The swivel device 70 is constructed as presented above. The air supply channels 86X–86Z are joined with the air supply pipes 74X, 74Y and 74Z, respectively, and the air is supplied to the air supply channels 86X–86Z from the compressor 72 via the air supply pipes 74X, 74Y and 74Z.

The valves 73X, 73Y and 73Z are provided to the air supply pipes 74X, 74Y and 74Z, respectively, and the air supply amount for each of the air hammer 16A–16C is adjusted by controlling the opening and closing amount of each of the valves 73X, 73Y and 73Z. The opening and closing of each of the valves 73X, 73Y and 73Z is separately controlled by a remote-controlled operation from the operation board 104 or a manual control.

In the multiple air hammer apparatus in the present embodiment, the deviation amount of the leading hammer 10 is measured by a transit, and its measuring method is as presented below.

Figure 12:
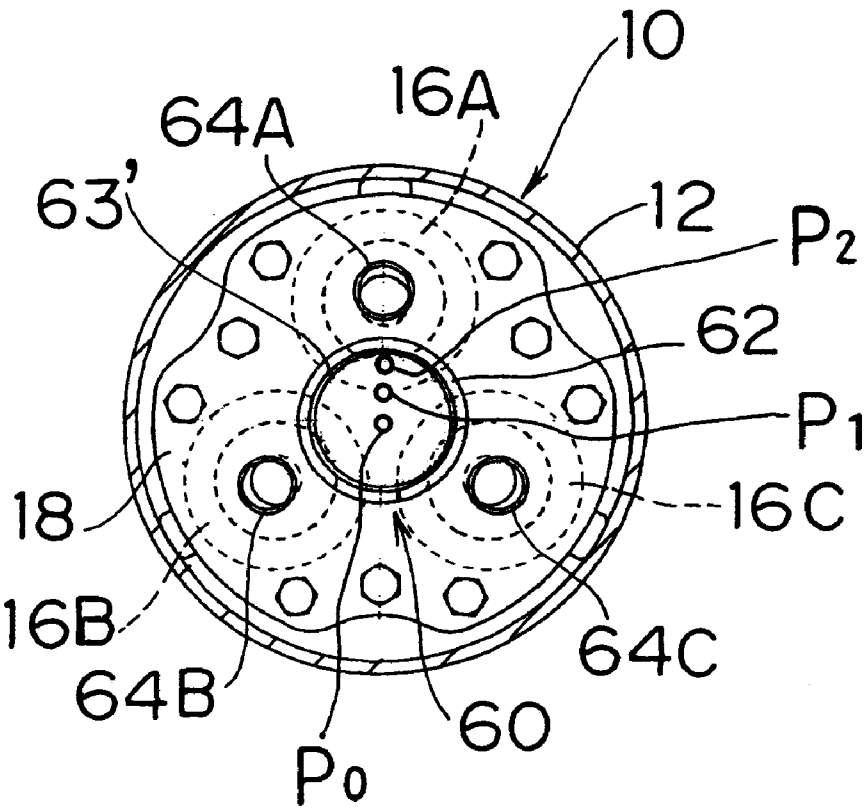
FIG. 12 is a front view of a target.
Figure 13A:
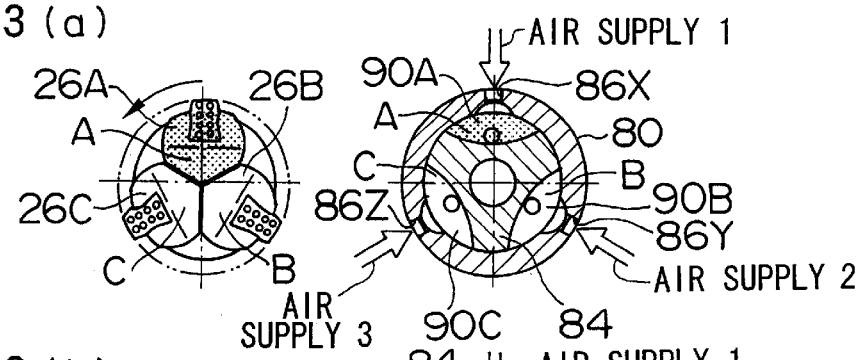
FIGS. 13(*a*)–13(*e*) are explanatory views for the operation of the multiple air hammer.
Figure 13B:
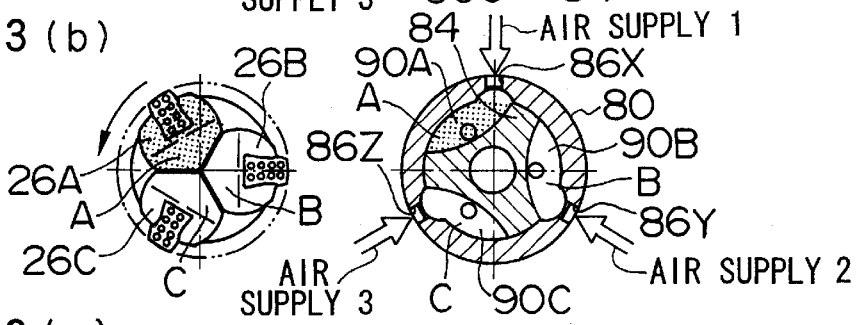
Figure 13C:
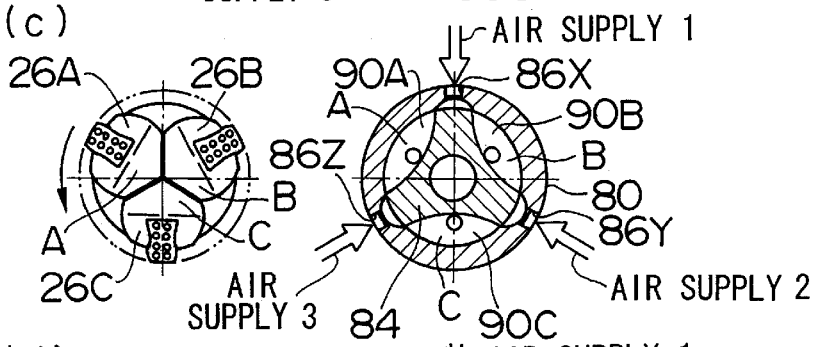
Figure 13D:
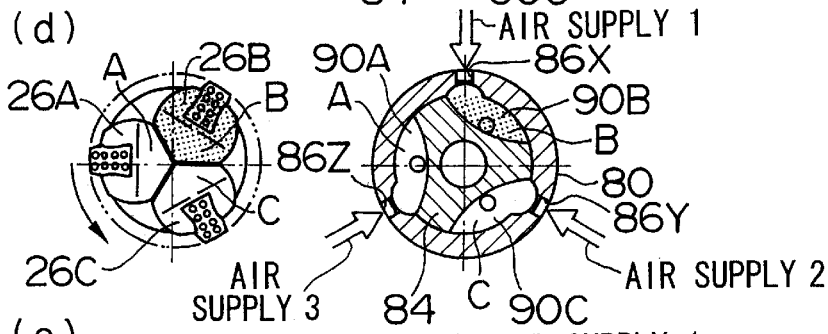
Figure 13E:
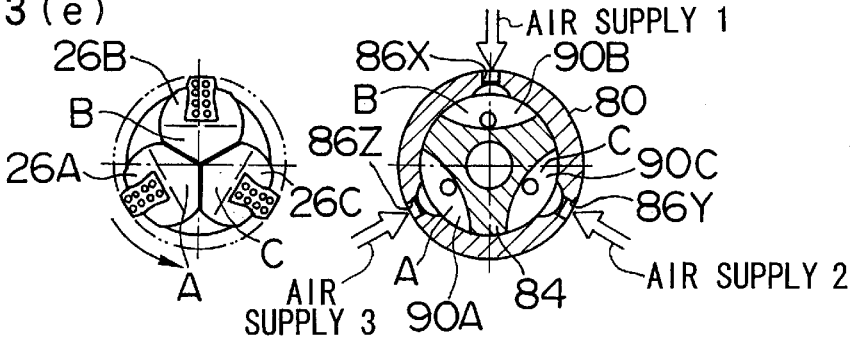

As shown in FIG. 12, a target 63' is provided in the hollow shaft 62 of the case rod 60. Three measurement points $P_0$, $P_1$ and $P_2$ are formed in the target 63', in which the measurement point $P_0$ is formed at the center of the hammer case 18 (that is, the center of the hollow shaft 62), and the measurement points $P_1$ and $P_2$ are formed on the straight line connecting the center of the hammer case 18 and the center of the air hammer 16A with a predetermined distance. The transit determines the deviation amount of the leading hammer 10 by measuring the position of the three measurement points $P_0$, $P_1$ and $P_2$ with respect to the planned design line. If the measurement point $P_0$ deviates upward with respect to the planned design line, that means the leading hammer 10 deviates upward. The position of the bit 26A, which is struck with the air hammer 16A, can be determined by determining the positions of the measurement points $P_1$ and $P_2$ with respect to the measurement point $P_0$.

The transit is provided in the same manner as the laser theodolite 106 in the first embodiment.

The target 63' may be provided in the hammer case 18.

The operation of the multiple air hammer apparatus of the present embodiment as described above is as presented below.

First, the operation principle of the air hammers 16A–16C using the swivel device 70 in the present embodiment is described.

When supplying the air from the compressor 72 to the air supply chambers 90A–90C of the swivel device body 76, the air is supplied to the air hammers 16A–16C through the air supply passages 92A–92C and the air supply pipes 3A–3C, and the air hammers 16A–16C are activated.

At this point, the air is supplied to each of the air supply chambers 90A–90C only when each of the air supply chambers 90A–90C and each of the air supply channels 86X–86Z communicate with each other. As shown in FIGS. 13(*a*), 13(*b*), 13(*d*) and 13(*e*), the air supply chambers 90A–90C rotate by following the rotation of the air hammers 16A–16C, and each of the air supply chambers 90A–90C communicates with the compressor 72 and is supplied with the air only when each of the air supply chambers 90A–90C and each of the air supply channels 86X–86Z communicate with each other. In contrast, as shown in FIG. 13(*c*), if the air supply channels 86X–86Z are blocked with the outer periphery of the rotation body 84, the air is not supplied to the air supply chambers 90A–90C.

According to the operation principle, if only the valve 73X is opened so as to supply the activation air to only the air supply channel 86X, the activation air is supplied to one of the air supply chambers 90A–90C that is communicating with the air supply channel 86X. By using this mechanism, only the earth in the direction of the air supply channel 86X can be selectively excavated. Moreover, if the opening rate of the valve 73X is set large and that of the valves 73Y and 73Z is set small, only the strike in the direction of the air supply channel 86X is made strong; consequently the apparatus can excavate the earth by providing the air hammers with striking power different from one hammer to another.

Now, a horizontal excavation method using the multiple air hammer apparatus in the present embodiment is described.

As shown in FIG. 1, first, the bits 26A–26C provided at the front end of the leading hammer 10 are contacted with the working face, and the propulsive cylinder 48 of the propulsive device 40 is driven, whereby the leading hammer 10 and the casing 12 are propelled.

At the same time as the driving of the propulsive cylinder 48, the rod rotating device 68 is driven to rotate the rod 1, whereby the rotation of the rod 1 is transmitted to the leading hammer 10 and the leading hammer 10 rotates.

Moreover, the compressor 72 is driven at the same time as the driving of the rod rotating device 68 and the valves 73X–73Z are opened. Thereby, the activation air is supplied from the compressor 72 to the air supply channels 86X–86Z of the swivel device body 76 through the air supply pipes 74X–74Z. The air is further supplied from the air supply channels 86X–86Z to the air hammers 16A–16C of the leading hammer 10 through the air supply chambers 90A–90C, the air supply passages 92A–92C and the air supply pipes 3A–3C, and the air hammers 16A–16C are thus activated. More specifically, the hammer pistons 22A–22C of the air hammers 16A–16C are activated so as to strike the bits 26A–26C, whereby the working face is repeatedly struck with the bits 26A–26C and crushed.

At this point, the bit teeth 28A–28C provided to the bits 26A–26C move in the direction to retract from the front end face by contacting with the working face and extends. By this extending of the bit teeth 28A–28C, the excavation hole 112 with the larger diameter than that of the casing 12 is excavated.

The soil that is excavated with the bits 26A–26C is discharged into the casing 12 through the space between the casing 12 and the hammer case 18 by the effect of the exhaust air. The excavated soil that is now discharged to the casing 12 is transported with the exhaust air to the soil discharging case 50 by the effect of the rotating rod 1, and is collected from the soil discharging case 50 by the soil discharging device 108.

As described above, in the normal excavation, the leading hammer 10 is rotated in one direction and the air hammers 16A–16C are uniformly activated so as to excavate the earth.

Next, the method for correcting the excavating direction in a case where the leading hammer 10 deviates from the planned design line is described.

Figures 14A, 14B, 14C, 14D, 14E:
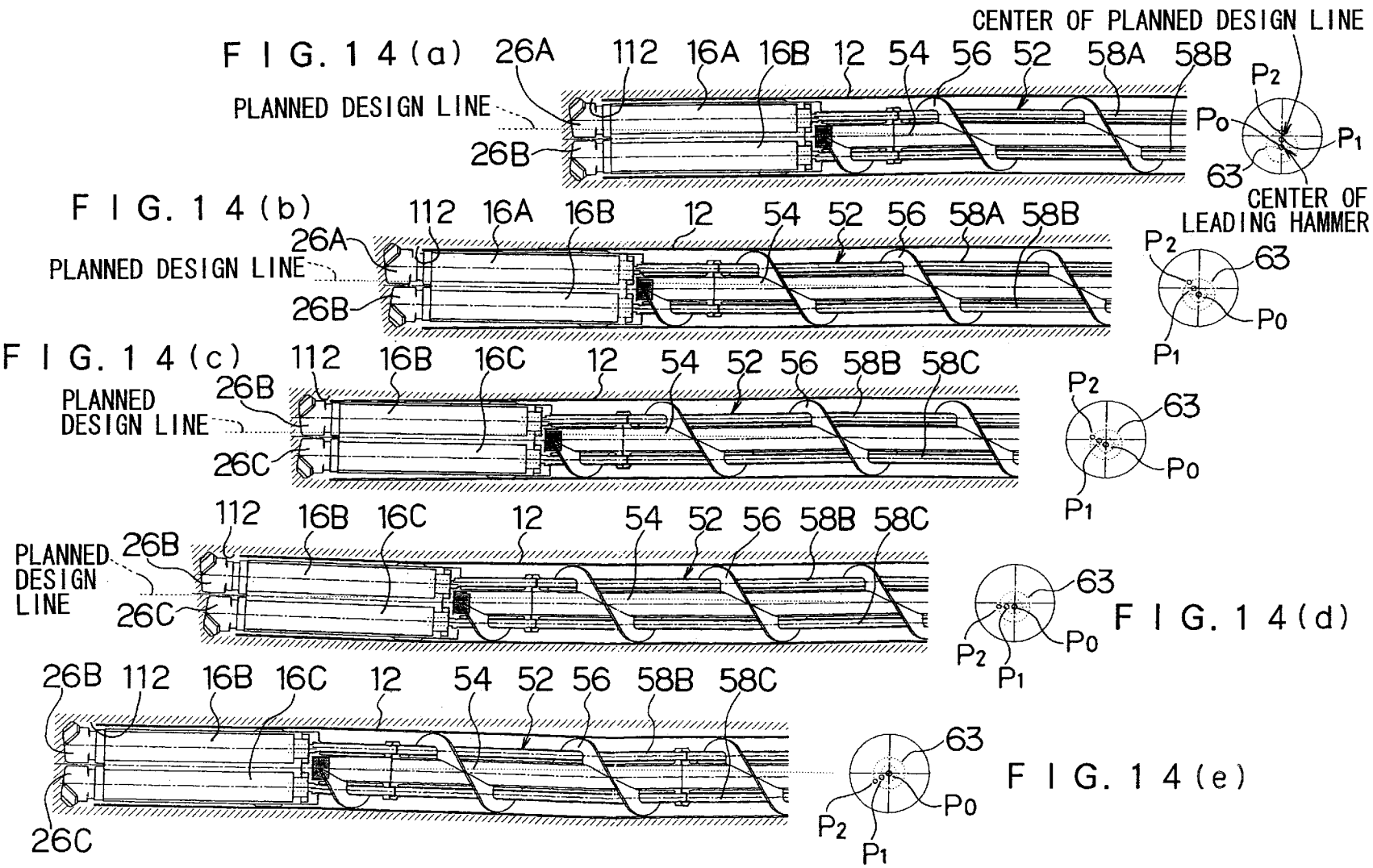
FIGS. 14(*a*)–14(*e*) are explanatory views for the operation of the multiple air hammer.

The fact that the leading hammer 10 deviates from the planned design line can be confirmed by determining the positions of the measurement points $P_0$–$P_2$ of the target 63' by the transit through a hollow 84*a* of the swivel device body 76 as shown in FIG. 12. When it is confirmed that, for example, the leading hammer 10 deviates just downward as shown in FIG. 14(*a*), one of the air supply channels 86X–86Z is positioned in the correct direction (in this case, just upward). For example, the air supply channel 86X is turned to the just upward direction as shown in FIG. 13(*a*). If the air supply channel 86X is at the position in the correct direction, the operation is unnecessary.

Then, the air pressure Px of the activation air that is supplied to the air supply channel 86X, which is positioned in the correct direction, is set to be higher than the air pressures Py and Pz of the activation air that is supplied to the air supply channels 86Y and 86Z, respectively (i.e., Px>Py=Pz), and the excavation is performed by supplying the air.

When the activation air with high pressure is supplied to only the air supply channel 86X in the above-described manner, only one of the air hammers that is of the air supply chamber that is communicating with the air supply channel

86X excavates the earth by stronger striking power than the other air hammers.

Since the air hammers 16A–16C are rotating, one of the air supply chambers 90A–90C communicating with the air supply channel 86X is successively changed. Because of that, one of the air hammers 16A–16C that excavates the earth with strong striking power successively changes, and only the air hammer that positions in the just upward direction excavates the earth with strong striking power. More specifically, the excavation is performed in the following manner.

When the air supply chamber 90A communicates with the air supply channel 86X as shown in FIG. 13(*a*), the activation air with high pressure is supplied to only the air supply chamber 90A, and the air hammer 16A, which communicates with the air supply chamber 90A, strikes the bit 26A with stronger striking power than the other air hammers 16B and 16C. As a result, the earth in the just upward direction is excavated with the strong striking power.

Since each of the air supply chambers 90A–90C has a predetermined width, the activation air with high pressure is supplied to only the air supply chamber 90A while the air supply chamber 90A communicates with the air supply channel 86X as shown in FIG. 13(*b*) even if the leading hammer 10 is rotating; as a result, only the air hammer 16A excavates the earth in the just upward direction with the strong striking power.

Then, the leading hammer 10 rotates and the air supply channel 86X is blocked by the outer periphery of the rotation body 84 as shown in FIG. 13(*c*), so that the activation air is supplied to neither of the air supply chambers 90A–90C; as a result, all the air hammers 16A–16C stop operating.

The leading hammer 10 moreover rotates and the air supply chamber 90B comes to communicate with the air supply channel 86X as shown in FIG. 13(*d*), so that the activation air with high pressure is now supplied to only the air supply chamber 90B. Thereby, only the air hammer 16B excavates the earth with the strong striking power. At this point, the air hammer 16B is positioned substantially in the just upward direction, and thus only the earth in the just upward direction is excavated with the strong striking power.

As described above, when excavating only the earth in the just upward direction with the strong striking power, the excavating direction of the leading hammer 10 is gradually corrected toward the just upward direction as shown in FIGS. 14(*a*)–(*d*), and at last, the center of the leading hammer 10 is positioned on the planned design line as shown in FIG. 14(*e*).

The fact that the center of the leading hammer 10 is positioned on the planned design line can be confirmed by determining with the transit that the measurement point $P_0$ of the target 63 corresponds with the center of the planned line.

The correcting operation is completed upon confirming that the center of the leading hammer 10 is positioned on the planned design line as described above, then the normal excavation is resumed. In other words, as shown in FIG. 13(*e*), the air pressure of the activation air that is supplied to each of the air supply channels 86X–86Z is set to be uniform (i.e., Px=Py=Pz), and the activation air is supplied to each of the air supply channels 86X–86Z. Thereby, the air hammers 16A–16C strike the bits 26A–26C, respectively, with the uniform striking power and progress straight and horizontally so as to excavate the earth.

As described above, the multiple air hammer apparatus in the present embodiment can correct the excavating direction by the easy operation of supplying the activation air, and its correcting operation can be successively performed. The excavating direction can be thus corrected efficiently. The multiple air hammer apparatus in the present embodiment does not need special equipment like a conventional multiple air hammer apparatus with a duplicate pipe structure, with a turning device, and so forth; hence, the entire device can be compact in size.

In the present embodiment, the case has been described where the excavating direction is corrected toward the just upward direction; if the excavating direction is corrected toward the left-hand side when viewing from the transit, the air supply channel 86X is turned to the left-hand side. In such case, the motor 94 of the swivel rotating device 78 is driven so as to rotate the case 80 of the swivel device body 76 so that the air supply channel 86X is turned to the left-hand side. Then, the air pressure Px of the activation air that is supplied to the air supply channel 86X is set higher than the air pressures Py and Pz of the activation air that is supplied to the other air supply channels 86Y and 86Z (i.e., Px>Py=Pz), and the activation air is supplied to the respective air supply channels 86X–86Z. Thereby, the earth in the left-hand side is struck with the strong striking power and thus the excavating direction of the leading hammer 10 is corrected toward the left-hand side.

Similarly, if the excavating direction is corrected toward the right-hand side when viewing from the transit, the air supply channel 86X is turned to the right-hand side, and the air pressure Px that is supplied to the air supply channel 86X is set higher than the air pressures Py and Pz that are supplied to the air supply channels 86Y and 86Z (i.e., Px>Py=Pz), and the activation air is supplied to the respective air supply channels 86X–86Z.

As described above, by turning one of the air supply channels to the correct direction, and by setting the air pressure that is supplied to the one of the air supply channels higher than the air pressures of the activation air that is supplied to the other air supply channels, the excavating direction can be corrected toward any direction of 360 degrees.

Moreover, an intermediate point between two of the air supply channels may be turned to the correct direction, and the air pressure of the activation air that is supplied to the two air supply channels may be set higher than the air pressure of the activation air that is supplied to the other air supply channel. For example, the intermediate point between the air supply channels 86X and 86Y is turned to the correct direction (in this case the air supply channel 86Z is turned in the opposite direction to the correct direction), and the air pressure of the activation air that is supplied to the air supply channels 86X and 86Y is set higher than the air pressure of the activation air that is supplied to the other air supply channel 86Z. Then, the activation air is supplied to the respective air supply channels 86X–86Z. Thereby, the two air hammers communicating with the air supply channels 86X and 86Y excavate the earth in the correct direction with the strong striking power and the excavating direction is corrected.

Now, other methods for correcting the excavating direction of the leading hammer 10 will be described.

First, one of the air supply channels 86X–86Z is turned to the position corresponding with the correct direction (for example, the just upward direction). In this case, as shown in FIG. 13(*a*), the air supply channel 86X, for example, is positioned at the just upward direction.

Second, the activation air is supplied to only the air supply channel 86X that has been at the position corresponding with the correct direction. At the same time, the propulsive cylinder 48 and the rod rotating device 68 are driven so as to rotate and propel the leading hammer 10. At this moment, because the activation air is supplied to only the air supply channel 86X, the activation air is supplied to only one of the air supply chambers 90A–90C that is communicating with the air supply channel 86X.

To describe in more detail, as shown in FIG. 13(*a*), the activation air is supplied to only the air supply chamber 90A when the air supply channel 86X communicates with the air supply chamber 90A; as a result, only the air hammer 16A is activated and thus only the earth in the just upward direction is excavated by the bit 26A.

Since each of the air supply chambers 90A–90C has the predetermined width, the activation air is supplied to only the air supply chamber 90A as shown in FIG. 13(*b*) while the air supply chamber 90A communicates with the air supply channel 86X even though the leading hammer 10 is rotating; consequently, only the air hammer 16A is activated.

Then, the leading hammer 10 rotates and the air supply channel 86X is blocked with the outer periphery of the rotation body 84 as shown in FIG. 13(*c*), so that the activation air is supplied to neither of the air supply chambers 90A–90C; as a result, all the air hammers 16A–16C stops operation.

After that, the leading hammer 10 moreover rotates and the air supply channel 86X comes to communicate with the air supply chamber 90B as shown in FIG. 13(*d*). At this time, the activation air is supplied to only the air supply chamber 90B; and only the air hammer 16B is thereby activated. At this moment, the air hammer 16B is positioned in the just upward direction, and thus only the earth in the just upward direction is excavated with the bit 26B.

Since each of the air supply chambers 90A–90C has the predetermined as described above, the activation air is supplied to only the air supply chamber 90B while the air supply chamber 90B communicates with the air supply channel 86X as shown in FIG. 13(*e*) even though the leading hammer 10 is rotating; consequently, only the air hammer 16B is activated and only the earth in the just upward direction is excavated by the air hammer 16B.

As described above, when supplying the activation air to only the air supply channel 86X, which is at the position corresponding with the just upward direction, only one of the air hammers that is at the position corresponding with the just upward direction is activated even though the leading hammer 10 rotates; so that only the earth in the just upward direction can be excavated. After the earth in the correct direction is excavated in the predetermined amount in the above-described manner, all the air hammers 16A–16C are activated so as to excavate the earth with all the bits 26A–26C. More specifically, all the valves 73X–73Z are uniformly opened and all the air hammers 16A–16C are uniformly activated. At this point, because the earth in the correct direction (in this case the earth in the just upward direction) has been excavated in advance, the leading hammer body 10 progresses gradually to the correct direction, and thus, the excavating direction can be corrected.

If the desired correction cannot be achieved by the correction operation at one attempt, the above-described operation is repeatedly performed. The normal excavation is resumed after the required correction amount can be obtained.

In a case where the excavating direction is corrected in the above-described manner, the apparatus of the present embodiment can easily correct the excavating direction by the easy operation for changing the supply of the activation air.

In the present embodiments, the three air supply channels 86X–86Z are formed at the case 80 of the swivel device body 76; however, the number of the air supply channels is not limited to three. For example, four channels may be formed at every 90 degrees, or six channels may be formed at every 60 degrees.

Moreover, in the present embodiments, the swivel device of the present invention is applied to the multiple air hammer apparatus; however, the swivel device of the present invention can be applied to another apparatus that is equipped with a plurality of excavation tools other than the air hammer.

The swivel device of the present invention can be applied also to another apparatus using a fluid other than the air.

In the embodiments presented above, the three air hammers 16A–16C are provided to the leading hammer body 10; however, the number of the air hammers is not limited to three.

Figure 15A:
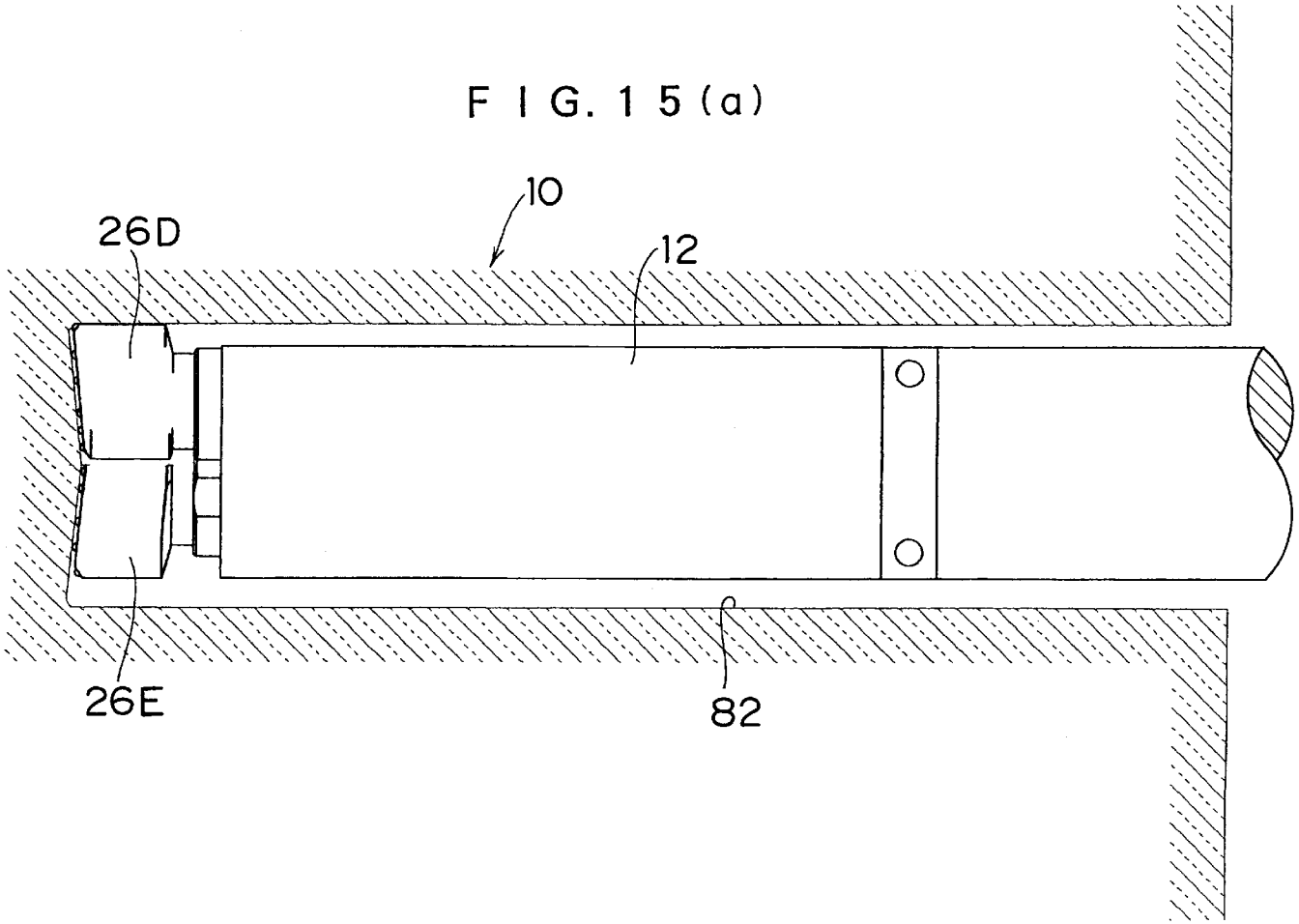
FIGS. 15(*a*) and 15(*b*) are a side view and a bottom view, respectively, of the multiple air hammer apparatus in another embodiment.
Figure 15B:
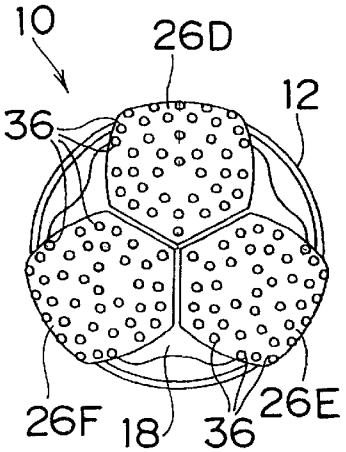

In the present embodiments, the bits provided with the extendable and contractible bit teeth 28A–28C are used; however, bits 26D–26F shown in FIGS. 15(*a*) and 15(*b*) without the extension/contraction function can be used in a case if the leading hammer body 10 does not have to be pulled out into the starting side and collected. As shown in FIG. 15(*b*), the bits 26D–26F have the same form, and they define a circle as a whole by joining to each other and project from the outer periphery of the casing 12.

In the above-described embodiments, the description is given to a case for excavating the earth horizontally (a propelling method); however, the present invention can be applied also to an excavation in the vertical direction.

As described hereinabove, the multiple air hammer apparatus and the excavating direction correcting method therefor according to the present invention is highly energy efficient and can easily correct the excavating direction, since the air hammers striking the bits are separately operatable.

Further, in the swivel device of the present invention, a fluid can be selectively supplied to only the supply pipe that is positioned in the direction of a particular supply channel by selectively supplying the fluid to the particular supply channel of the plurality of supply channels. Still further, by using the swivel device of the present invention to the multiple air hammer apparatus, the earth in the particular direction can be selectively excavated by adjusting the supply pressure of the activation air that is supplied to each of the air supply channels of the swivel device, and thus, the excavating direction can be corrected easily as well as efficiently.

Furthermore, according to the rod of the present invention, the air can be separately supplied to the respective air hammers from the plurality of air supply pipes disposed around the main pipe; thereby the respective air hammers can be separately operated. In addition, the excavated soil can be efficiently discharged with the auger wings which are attached around the main pipe regardless of the excavation distance.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A multiple air hammer apparatus comprising a plurality of air hammers for striking bits mounted at a front end are disposed in a case, said plurality of air hammers being activated by air supply via a plurality air supply pipes, each one of said plurality of air pipes being adapted to correspond to a respective one of said plurality of air hammers; and control means for selectively adjusting the air flow to each one of said plurality of air hammers, wherein each one of the plurality of air hammers is independently operable via said control means.

2. The multiple air hammer apparatus as defined in claim 1, wherein the bits are provided with an extending/contracting mechanism.

3. The multiple air hammer apparatus according to claim 1, further comprising a swivel device which supplies fluid into each of a plurality of rotating pipes, the swivel device comprising:

a rotation body which is rotatably connected to a swivel case, an end of the rotation body being connected with the plurality of supply pipes;

a plurality of recesses which are formed at the rotation body at predetermined intervals and define supply chambers between the rotation body and the swivel case;

a plurality of supply passages which are formed at the rotation body and respectively connect the supply chambers and the supply lines to each other; and a plurality of supply channels which are formed at the case at predetermined intervals and communicate with the swivel case.

4. The multiple air hammer apparatus according to claim 1, further comprising:

a rotation body which is rotatably connected to a swivel case, an end of the rotation body being connected with a plurality of supply pipes;

a plurality of recesses which are formed at the rotation body at predetermined intervals and define supply chambers between the rotation body and the swivel case;

a plurality of supply passages which are formed at the rotation body and respectively connect the supply chambers and the supply lines to each other;

a plurality of supply channels which are formed at the swivel case at predetermined intervals and communicate with the swivel case; and an air supply device for supplying activation air to each one of said plurality of supply channels.

5. The multiple air hammer apparatus according to claim 1, further comprising:

a target provided on a central axis of the case, the target being provided with a plurality of measurement points on a line from the center to a radial direction at predetermined intervals, wherein a deviation of the case with respect to a planned design line is determined by determining positions of the plurality of measurement points with respect to the planned design line.

6. The multiple air hammer apparatus according to claim 1, further comprising a rod which supplies air to the plurality of air hammers and transmits rotation force and propulsive power to the multiple air hammers apparatus, wherein the rod comprises:

a main pipe which is hollow;

a plurality of air supply pipes disposed around the main pipe, the plurality of air supply pipes respectively supplying the air to the air hammers; and connections which are formed at both ends of the main pipe and the plurality of air supply pipes.

7. The multiple air hammer apparatus as defined in claim 6, further comprising an auger wing arranged around the main pipe.

8. The multiple air hammer apparatus as defined in claim 6, further comprising a water supply pipe arranged around the rod.

9. The multiple air hammer apparatus as defined in claim 8, further comprising an auger wing arranged around the main pipe.

10. An excavation direction correcting method of a multiple air hammer apparatus in which a plurality of air hammers for striking bits mounted at a front end are disposed in a case and are activated by air supply via a plurality air supply pipes, each one of said plurality of air pipes being adapted to correspond to a respective one of said plurality of air hammers; and control means for selectively adjusting the air flow to each one of said plurality of air hammers and thereby selectively adjusting a striking power of each of the bits so as to correct an excavation direction.

11. A multiple air hammer apparatus comprising:

a hammer case;

a plurality of air hammers housed and arranged in the hammer case, said plurality of air hammers being activated by air supply so as to strike bits mounted at a front end;

a rod which is coaxially connected with a back end of the hammer case;

a plurality of supply pipes which are connected with the hammer case and which supply activation air to the air hammers, respectively;

a swivel device which supplies the activation air from an air supply device to the plurality of supply pipes; and control means for selectively adjusting the air flow to each one of said plurality of air hammers so as to render each one of the plurality of air hammers independently operable, wherein the multiple air hammers apparatus is arranged so as to be insertable into a casing.

* * * * *